US010060217B2

(12) United States Patent
Murphree et al.

(10) Patent No.: US 10,060,217 B2
(45) Date of Patent: Aug. 28, 2018

(54) LATTICE SEAL PACKER ASSEMBLY AND OTHER DOWNHOLE TOOLS

(71) Applicant: HALLIBURTON ENERGY SERVICES, INC., Houston, TX (US)

(72) Inventors: Zachary Ryan Murphree, Dallas, TX (US); Michael Linley Fripp, Carrollton, TX (US); Thomas Jules Frosell, Irving, TX (US); John Charles Gano, Carrollton, TX (US); Xiaoguang Allan Zhong, Plano, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 15/537,062

(22) PCT Filed: Feb. 17, 2015

(86) PCT No.: PCT/US2015/016190
§ 371 (c)(1),
(2) Date: Jun. 16, 2017

(87) PCT Pub. No.: WO2016/133498
PCT Pub. Date: Aug. 25, 2016

(65) Prior Publication Data
US 2017/0342797 A1 Nov. 30, 2017

(51) Int. Cl.
*E21B 33/12* (2006.01)
*E21B 33/122* (2006.01)

(52) U.S. Cl.
CPC ..... *E21B 33/1208* (2013.01); *E21B 33/122* (2013.01)

(58) Field of Classification Search
CPC ... E21B 43/084; E21B 33/1208; E21B 33/122
See application file for complete search history.

(56) References Cited

U.S. PATENT DOCUMENTS 5,165,703 A * 11/1992 Morvant ..... E21B 33/1208 277/342
6,581,682 B1 6/2003 Parent et al.
(Continued)

FOREIGN PATENT DOCUMENTS

EP 1680573 B1 7/2008

OTHER PUBLICATIONS

International Search Report and Written Opinion for International Application No. PCT /US2015/019243 dated Sep. 25, 2015, (8 pages).

*Primary Examiner* — David J Bagnell
*Assistant Examiner* — Yanick A Akaragwe
(74) *Attorney, Agent, or Firm* — Haynes and Boone, LLP

(57) ABSTRACT

A downhole tool includes an elongated base pipe and a expandable element disposed on the base pipe and radially expandable from a first configuration to a second configuration. The expandable element includes a first lattice structure that includes a first plurality of connecting members; a second plurality of connecting members movable relative to the first plurality of connecting members to allow the expandable element to radially expand from the first configuration to the second configuration; and a plurality of cells, each of the cells being defined between at least two connecting members. Each of the connecting members from the at least two connecting members is from the first plurality of connecting members or from the second plurality of connecting members. In one or more exemplary embodiments, the first lattice structure is at least partially manufactured using an additive manufacturing process.

18 Claims, 9 Drawing Sheets

(56) References Cited

U.S. PATENT DOCUMENTS

| | | | | |
|---|---|---|---|---|
| 8,776,876 | B2 | 7/2014 | Hart et al. | |
| 2004/0026313 | A1* | 2/2004 | Arlon Fischer | B01D 29/111 210/484 |
| 2008/0251250 | A1 | 10/2008 | Brezinski et al. | |
| 2010/0038860 | A1 | 2/2010 | Cour | |
| 2011/0240286 | A1* | 10/2011 | Williams | E21B 41/00 166/207 |
| 2016/0145968 | A1* | 5/2016 | Marya | E21B 33/1208 166/386 |

* cited by examiner

LATTICE SEAL PACKER ASSEMBLY AND OTHER DOWNHOLE TOOLS

TECHNICAL FIELD

The present disclosure relates generally to a packer assembly and other downhole tools used in wells, and specifically, to a lattice seal packer assembly.

BACKGROUND

After a well is drilled and a target reservoir has been encountered, completion and production operations are performed, which may include sand control processes to prevent formation sand, fines, and other particulates from entering production tubing along with a formation fluid. Typically, one or more sand screens may be installed along the formation fluid flow path between production tubing and the surrounding reservoir. Additionally, the annulus formed between the production tubing and the casing (if a cased hole) or the formation (if an open hole) may be packed with a relatively coarse sand or gravel during gravel packing operations to filter the sand from the formation fluid. This coarse sand or gravel also supports the borehole in uncased holes and prevents the formation from collapsing into the annulus.

Generally, gravel packing operations include placing a lower completion assembly downhole within the target reservoir. The lower completion assembly may include one or more screens along the production tubing that is disposed between packer assemblies. After the lower completion assembly is placed in the desired location downhole, the packer assemblies are set (e.g., expanding or swelling the packer) to define zones within the annulus.

Often, a packer in the packer assembly includes rubber elements, which may be incompatible with certain downhole fluids. Additionally, the stiffness of rubber elements are often dependent on localized temperatures downhole, which may limit the completion operations.

The present disclosure is directed to a packer assembly that includes a lattice seal that addresses one or more of the foregoing issues.

BRIEF DESCRIPTION OF THE DRAWINGS

Various embodiments of the present disclosure will be understood more fully from the detailed description given below and from the accompanying drawings of various embodiments of the disclosure. In the drawings, like reference numbers may indicate identical or functionally similar elements.

DETAILED DESCRIPTION

Figure 1:
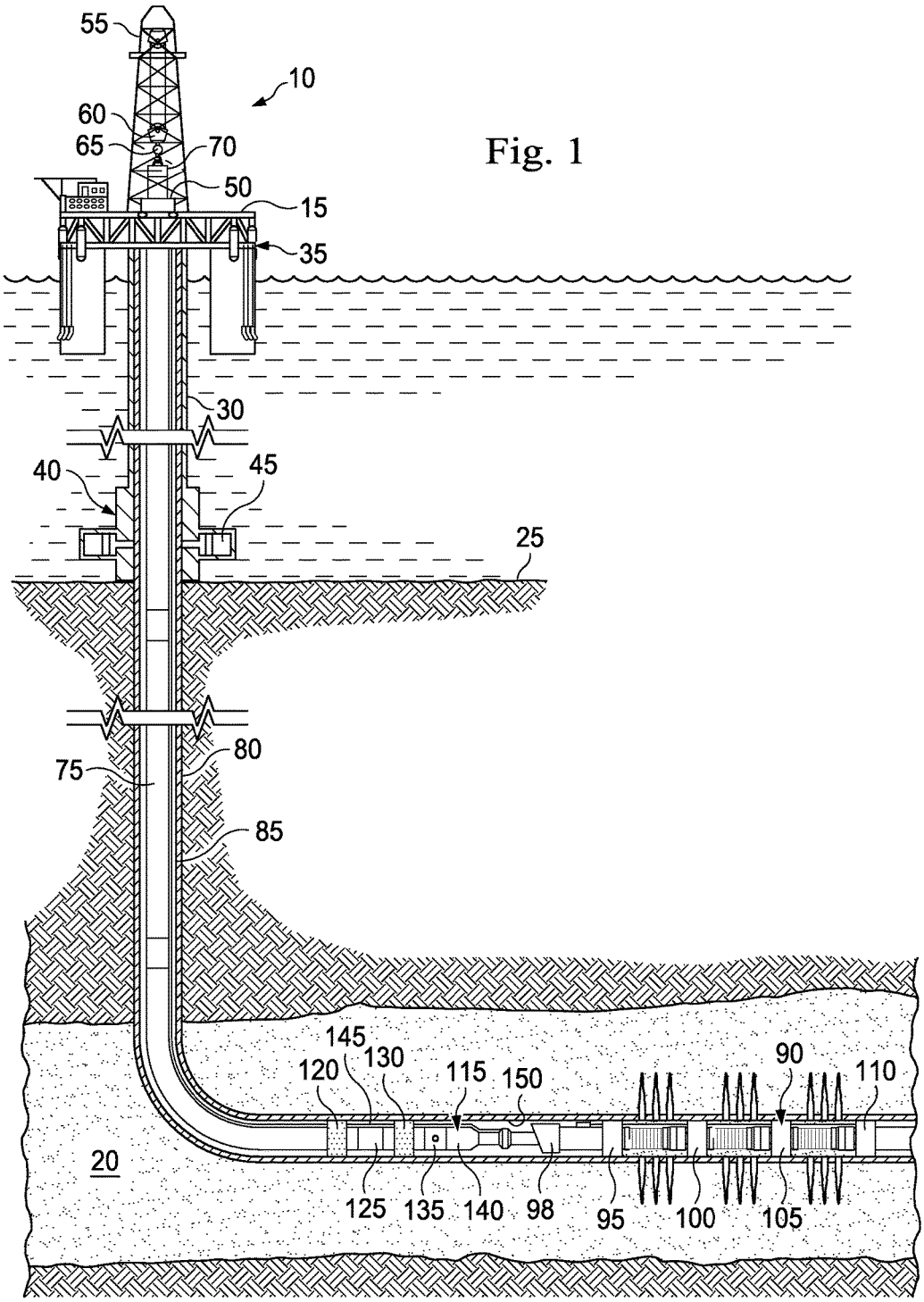
FIG. 1 is a schematic illustration of an offshore oil and gas platform operably coupled to a lattice sealing element, according to an exemplary embodiment of the present disclosure.

Illustrative embodiments and related methods of the present disclosure are described below as they might be employed in a lattice seal packer assembly and method of operating the same. In the interest of clarity, not all features of an actual implementation or method are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and related methods of the disclosure will become apparent from consideration of the following description and drawings.

The foregoing disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures. For example, if the apparatus in the figures is turned over, elements described as being "below" or "beneath" other elements or features would then be oriented "above" the other elements or features. Thus, the exemplary term "below" may encompass both an orientation of above and below. The apparatus may be otherwise oriented (rotated 90 degrees or at other orientations) and the spatially relative descriptors used herein may likewise be interpreted accordingly.

Referring initially to FIG. 1, a well having a lattice seal packer assembly is disposed therein from an offshore oil or gas platform that is schematically illustrated and generally designated 10. A semi-submersible platform 15 may be positioned over a submerged oil and gas formation 20 located below a sea floor 25. A subsea conduit 30 may extend from a deck 35 of the platform 15 to a subsea wellhead installation 40, including blowout preventers 45. In one or more exemplary embodiments, the platform 15 may have a hoisting apparatus 50, a derrick 55, a travel block 60, a hook 65, and a swivel 70 for raising and lowering pipe strings, such as a substantially tubular, axially extending working string 75. In one or more exemplary embodiments, a wellbore 80 extends through the various earth strata including the formation 20 and has a casing string 85 cemented therein. In one or more exemplary embodiments, disposed in a substantially horizontal portion of the wellbore 80 is a lower completion assembly 90 that generally includes at least one flow regulating system and packers 95, 100, 105, and 110. Disposed in the wellbore 85 at the lower end of the working string 75 is an upper completion assembly 115 that may include various components such as a packer 120 that is a lattice seal packer assembly, an expansion joint 125, a packer 130, a fluid flow control module 135, and an anchor assembly 140. In one or more exemplary embodiments, one or more communication cables such as an electric cable 145 that passes through the packers 120, 130 may be provided and extend from the upper completion assembly 115 to the surface in an annulus 150 between the working string 75 and the casing 85. In one or more exemplary embodiments, the packer 120 permanently seals the annulus 150.

Even though FIG. 1 depicts a horizontal wellbore, it should be understood by those skilled in the art that the apparatus according to the present disclosure is equally well suited for use in wellbores having other orientations including vertical wellbores, slanted wellbores, multilateral wellbores or the like. Accordingly, it should be understood by those skilled in the art that the use of directional terms such as "above," "below," "upper," "lower," "upward," "downward," "uphole," "downhole" and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the apparatus according to the present disclosure is equally well suited for use in onshore operations. Further, even though FIG. 1 depicts a cased hole completion, it should be understood by those skilled in the art that the apparatus according to the present disclosure is equally well suited for use in open hole completions. Further, even though FIG. 1 depicts a completion, it should be understood by those skilled in the art that the apparatus according to the present disclosure is equally well suited for us in a drilling application, stimulation application, monitoring application, and other applications that has a wellbore that intersects a subterranean formation.

Figure 2:
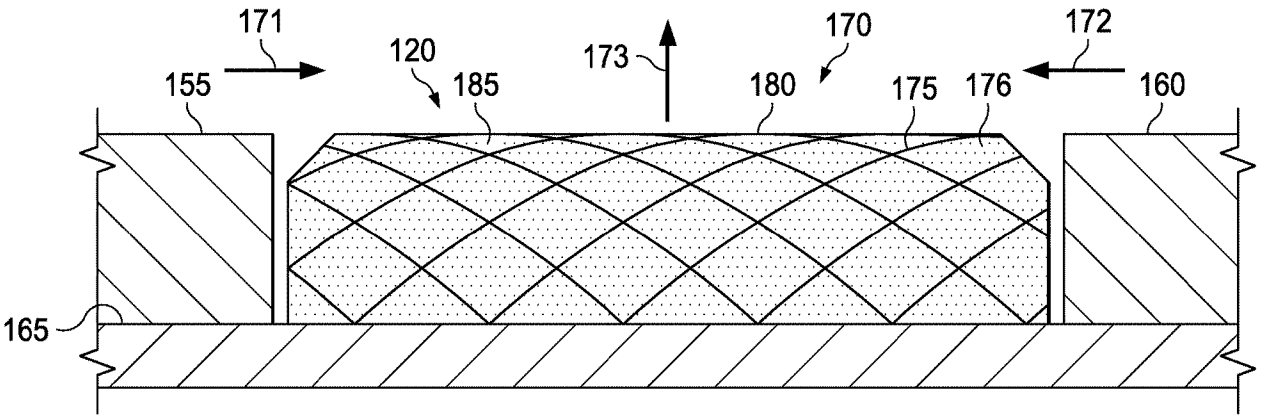
FIG. 2 illustrates a sectional view of a portion of the lattice sealing element of FIG. 1, according to an exemplary embodiment of the present disclosure.

In one or more exemplary embodiments, and as illustrated in FIG. 2, the packer 120 includes blocking members 155 and 160 that are concentrically disposed about a mandrel 165 and axially spaced apart along the packer 120. In one or more exemplary embodiments, an expandable element such as a lattice seal 170 is concentrically disposed about the mandrel 165 and accommodated between the blocking members 155 and 160. In one or more exemplary embodiments, the blocking members 155 and 160 are located adjacent the lattice seal 170 such that the blocking members 155 and 160 apply a compression force on the lattice seal 170 during setting of the packer 120 in the directions indicated by numerals 171 and 172 in FIG. 2, respectively. In response, the lattice seal 170 moves or expands in the radial direction, or the direction indicated by numeral 173 in FIG. 2. In one or more exemplary embodiments, the lattice seal 170 includes a lattice structure 175 that forms a plurality of cells, with each cell from the plurality of cells corresponding to a void from a plurality of voids 176.

Figure 3:
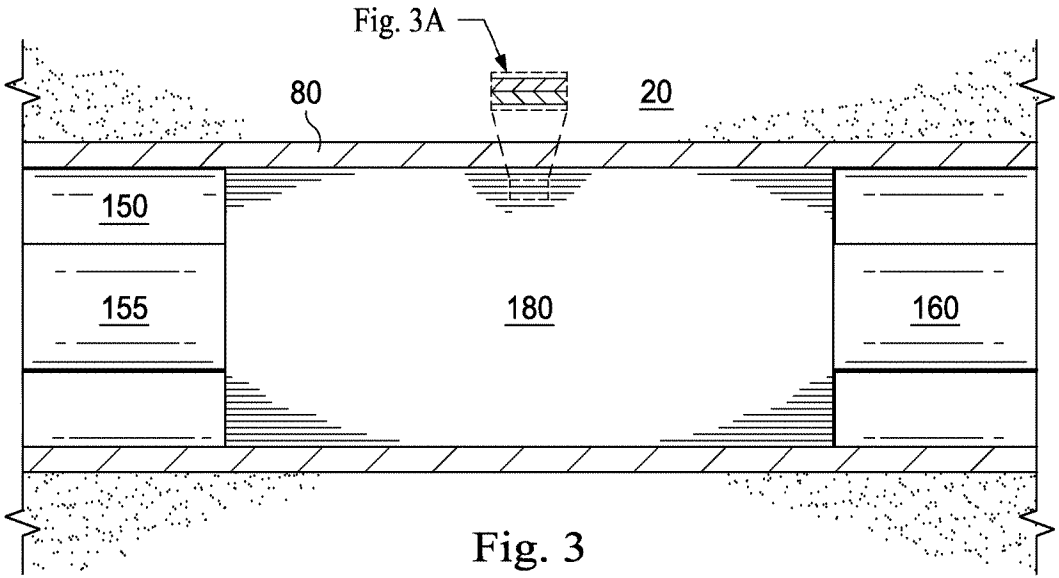
FIG. 3 illustrates a side view of a portion of the lattice sealing element of FIG. 2 when axial compression is applied, according to an exemplary embodiment of the present disclosure, the lattice sealing element including lattice elements.
Figure 3A:
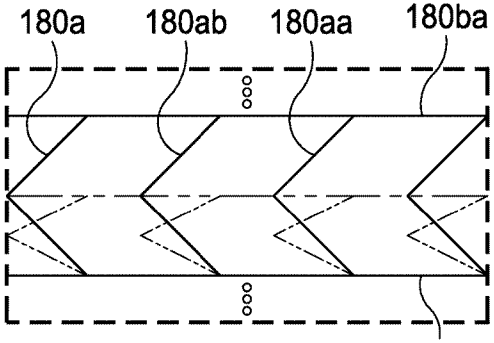
FIG. 3A is a diagrammatic illustration of the lattice elements of FIG. 3, according to an exemplary embodiment of the present disclosure.

In one or more exemplary embodiments, the lattice cell is shaped such that it is adapted to expand radially when compressed axially such that the seal 170 expands in the radial direction indicated by numeral 173 when the blocking members 155 and 160 compress the seal 170 in the directions indicated by the numerals 171 and 172 (i.e., axial compression). In one or more exemplary embodiments, the blocking members 155 and 160 compress the lattice seal 170 until the lattice structure 175 acts as a solid structure (i.e., at least a portion of the voids within the plurality of voids 176 formed within the lattice structure 175 are eliminated) and the lattice structure 175 contacts the casing 80 to form a sealing surface that sealingly engages the inner surface of the casing 80 to fluidically isolate at least a portion of the inner surface of the casing 80. In one or more exemplary embodiments, the lattice seal 170 includes a skin 180 that surrounds at least a portion of the lattice structure 175. In one or more exemplary embodiments, the skin 180 is a solid material that acts as the sealing surface when the lattice seal 170 expands in the radial direction to contact the inner surface of the casing 80. However, there are a variety of ways that the lattice seal 170 may form the sealing surface. For example, the lattice cells may be infiltrated with an elastomer 185 and the elastomer 185 acts as the sealing surface when the lattice seal 170 expands in the radial direction to contact the inner surface of the casing 80. In one or more exemplary embodiments, the elastomer 185 may be a swelling elastomer and the lattice structure 175 expands in the radial direction in response to the swelling of the swellable elastomer 185. In one or more other exemplary embodiments, the lattice cells may be infiltrated with a powder that acts as a semi-compressible material, such as a metal powder that is a residue of additive manufacturing. In another example, the lattice cells are filled with salts/scale from the wellbore fluids. Generally, as seal 170 expands in the radial direction, an outer circumference of the seal 170 increases. In one or more exemplary embodiments, the skin 180 expands to allow for the increase in outer circumference. In one or more exemplary embodiments, the skin 180 includes connecting members 180*a* that extend between axial ribs 180*b* as shown in FIG. 3. As the lattice seal 170 expands radially, the axial ribs 180*b* move relative to each other while remaining connected to the connecting members 180*a*, thereby allowing for the radial expansion of the seal 170 and the resulting increase of the outer circumference of the seal 170. For example, a lattice cell at least partially formed from an axial rib 180*ba*, an axial rib 180*bb*, a connecting member 180*aa*, and a connecting member 180*ab* expands such that a plurality of connecting members that includes the axial rib 180*ba* moves relative to another plurality of connecting members that include the axial rib 180*bb*.

Figure 4:
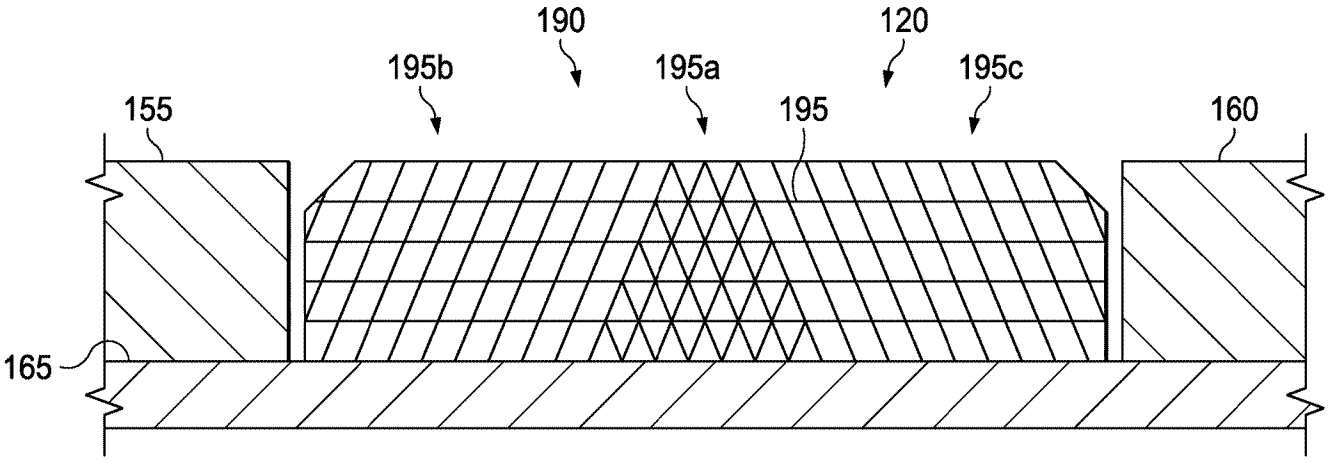
FIG. 4 illustrates a sectional view of portion of the lattice sealing element of FIG. 1, according to another exemplary embodiment of the present disclosure.

In one or more other exemplary embodiments, the lattice seal 170 may expand outward by "buckling" outward towards the casing 80 to form the sealing surface. In one or more exemplary embodiments and as shown in FIG. 4, the packer 120 includes a lattice seal 170 that is a buckling seal 190. In one or more exemplary embodiments, the buckling seal 190 may include a seal structure 195 that is non-uniform. In one or more exemplary embodiments, the seal structure 195 has a middle portion 195*a* having a first lattice structure that is axially located between end portions 195*b* and 195*c*, with each having a second lattice structure. In one or more exemplary embodiments, the first lattice structure is more rigid than the second lattice structure. In one or more exemplary embodiments, the second lattice structure is formed of cells having a trapezoidal shape. In one or more exemplary embodiments, the second lattice structure is formed of cells that have a greater cell wall thickness than the cells forming the first lattice structure. In one or more exemplary embodiments and due to the differences in the first lattice structure and the second lattice structure, the blocking members 155 and 160 compress the buckling seal 190 axially to force the middle portion 195*a* in the radial direction and towards the casing 80. Thus, the middle portion 195 forms the sealing surface that sealingly engages the inner surface of the casing 80 to fluidically isolate at least a portion of the inner surface of the casing 80. While only the first lattice structure and the second lattice structure are shown in FIG. 4, in one or more exemplary embodiments, the lattice structure 175 and/or the seal structure 195 may include any number of lattice structures in each direction. For example, the seal structure 195 may include more than two lattice structures in the axial direction, more than four lattice structures in the axial direction, or more than eight lattice structures spaced in the axial direction. Alternatively, the seal structure 195 may have any number of lattice structures spaced in the radial direction.

Figure 5:
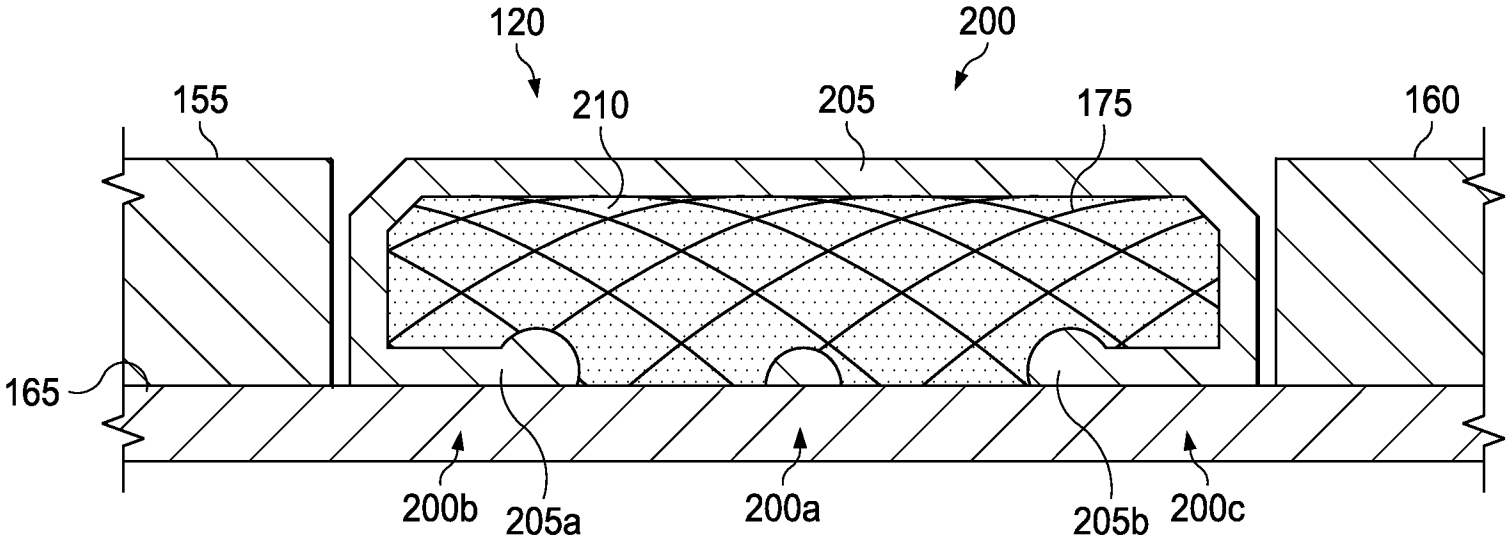
FIG. 5 illustrates a sectional view of a portion of the lattice sealing element of FIG. 1, according to yet another exemplary embodiment of the present disclosure.

In one or more exemplary embodiments and as illustrated in FIG. 5, the packer 120 includes a seal 170 that is a hybrid seal 200 that may "buckle" outward towards the casing 80 to form the sealing surface instead of relying on radial expansion of the lattice seal 170. In one or more exemplary embodiments, the seal 200 includes a shell 205 that at least partially surrounds the lattice structure 175 having at least a portion of the lattice cells filled with an elastomer 210. In one or more exemplary embodiments, the elastomer 210 includes a medium (i.e., between 60 and 90 on the Durometer scale) Durometer rubber and the shell 205 includes a low (i.e., between 30 and 70 on the Durometer scale) Durometer rubber. In one or more exemplary embodiments, the shell 205 has a thickness of less than 0.040 inches. In one or more exemplary embodiments, the shell 205 is concentrically disposed about the mandrel 165. In one or more exemplary embodiments, the shell 205 forms protrusions 205*a* and 205*b* spaced axially and coupled to the mandrel 165. In one or more exemplary embodiments, the protrusions 205*a* and 205*b* at least partially define a middle portion 200*a* of the seal 200 that is axially located between end portions 200*b* and 200*c*. In one or more exemplary embodiments, the protrusions 205*a* and 205*b* prevent or discourage the radius of the end portions 200*b* and 200*c* from changing and anchor the seal 200 to the mandrel 165. As the seal 200 is compressed by the blocking members 155 and 160, the middle portion 200*a* of the seal 200 buckles outward toward the casing 80 to form the sealing surface. In one or more exemplary embodiments, the shell 205 closes or reduces any extrusion gap that the elastomer 210 might be squeezed through. In one or more exemplary embodiments, the thin, low Durometer rubber shell 205 acts to seal the annulus 150 and is sufficiently thin to prevent the elastomer 210 from debonding from the shell 205 under shear loading. In one or more exemplary embodiments, the seal 200 reduces the occurrence of swab-off and premature setting without the use of additional downhole tools.

In one or more exemplary embodiments, a method of operating the packer 120 may include positioning the packer 120 between adjacent first and second zones of a wellbore and expanding the seal 170, 190, or 200 in a radially outward direction to sealingly engage the inner surface of the casing 80 and to move a first plurality of connecting members relative to a second plurality of connecting members. In one or more exemplary embodiments, expanding the seal 170 includes sealingly engaging the elastomer 185 against the inner surface of the casing 80. In one or more exemplary embodiments, expanding the seal element 200 includes sealingly engaging the elastomer 210 against the inner surface of the casing 80. In one or more exemplary embodiments, expanding the seal 170 includes capturing debris from downhole fluids within one or more of the plurality of cells such that the seal 170 expands radially outward.

In one or more exemplary embodiments, any one of the lattice seals 170, 190, and 200 eliminates the need for a back-up system and dramatically reduces the possibility of element swab-off and premature set in permanent packer elements, such as the packer 120. In one or more exemplary embodiments, any one of the lattice seals 170, 190, and 200 also enables higher temperature operation and use in a wide range of fluids. In one or more exemplary embodiments, any one of the lattice seals 170, 190, and 200 that is comprised of a metal may perform the load bearing functionality of slips, allowing for the traditional slips to be removed which reduces the length, complexity, and manufacturing cost of the packer assembly 120. In one or more exemplary embodiments, omission of the slips would also reduce movement during pressure reversals that could meet more demanding requirements from operators for cyclic testing.

Exemplary embodiments of the present disclosure can be altered in a variety of ways. In some embodiments, any one of the lattice seals 170, 190, and 200 is not limited use with the packer 120, but may be included in any one of a variety of downhole tools. Additionally, the lattice structure 175 may be included in any one of variety of downhole tools, such as for example an expansion joint; a travel joint; a seal bore; an anchor such as for example a liner hanger; and a bridge plug. In one or more exemplary embodiments, the lattice structure 175 may be used as to energize a spring or a collet that forms a part of a downhole tool.

In one or more exemplary embodiments, the lattice structure 175 may comprise a lattice elements, such as for example a plurality of rods, plates, acicular elements, corpuscular elements, solids, or any other component. In one or more exemplary embodiments, the lattice structure 175 may be a uniform lattice, a conformal lattice, or a non-uniform lattice. In one or more exemplary embodiments, the geometry of the lattice structure 175 does not vary in the uniform lattice. In one or more exemplary embodiments, the lattice elements of the uniform lattice are parallel with each other on different sides of the lattice structure 175. In one or more exemplary embodiments, the lattice elements are distorted to follow the geometry of the lattice structure 175 in the conformal lattice. In one or more exemplary embodiments, the non-uniform lattice structure may include a continuous gradation of cells as a function of position along the lattice structure 175. In one or more exemplary embodiments, the variation may include cell shape, density, size, mechanical properties, or any other property affected by geometric changes. In one or more exemplary embodiments, the lattice structure 175 includes a first plurality of lattice elements or connecting members and a second plurality of lattice elements or connecting members that move relative to the first plurality of connecting members. In one or more exemplary embodiments, one of more of the lattice cells is formed from at least two connecting members, with each of the at least two connecting members being from the first plurality of connecting members or from the second plurality of connecting members. In one or more exemplary embodiments, the lattice structure 175 is comprised of a metal. In one or more exemplary embodiments, the lattice structure 175 is comprised of a plastic. In one or more exemplary embodiments, the lattice seal 170 and/or the lattice structure includes a metamaterial. In one or more exemplary embodiments, the metamaterial achieves unique properties by using a precise design. In one or more exemplary embodiments, the metamaterial gains unique properties due to unique use of repeating patterns in the construction of the metamaterial. For example, the shape, geometry, size, orientation, and arrangement of patterns are used to create mechanical properties of the bulk structure of the metamaterial that are different from the mechanical properties of the raw material. In one or more exemplary embodiments, the lattice structure 175 includes lattice elements that have a center-to-center spacing of any of one: less than 0.5 inches; less than 0.25 inches; less than 0.1250 inches; and less than 0.625 inches.

Figure 6:
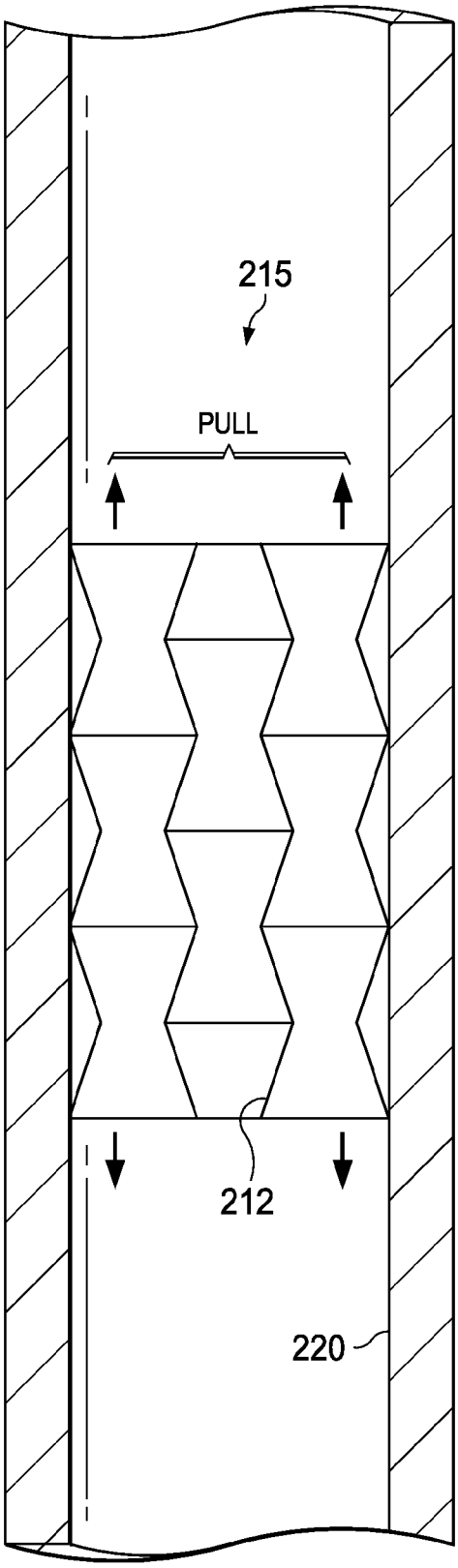
FIG. 6 is a diagrammatic illustration of a sectional view of a tension plug, according to an exemplary embodiment of the present disclosure.

In one or more exemplary embodiments, the lattice structure 175 may be an auxetic lattice 212 and form a portion of a plug 215 as illustrated in FIG. 6. In one or more exemplary embodiments, the auxetic lattice 212 forms a material having a negative Poisson's ratio and expands radially when under tension. Thus, an auxetic material will have an expanding neck as it is pulled, or placed under tension. Thus, the plug 215 self-seals against a tubing or casing 220 when tension is applied to the plug 215. In one or more exemplary embodiments, applying additional tension on the plug 215 causes the plug to further expand its diameter. Thus, pulling harder on the plug 215 causes the plug 215 to seal even more firmly against the tubing or casing 220.

Figure 7:
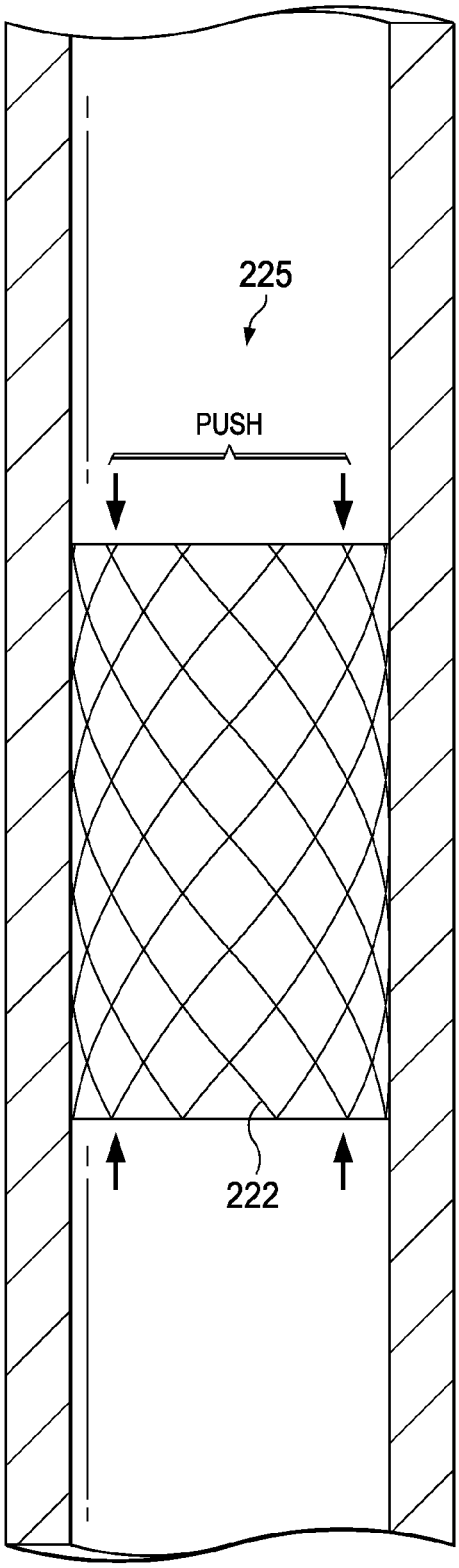
FIG. 7 is a diagrammatic illustration of a sectional view of a compression plug, according to an exemplary embodiment.

In one or more exemplary embodiments, the lattice structure 175 may create a first material 222 that has a high Poisson's ratio and that forms a portion of compression plug or a bridge plug 225 as illustrated in FIG. 7. In one or more exemplary embodiments, the first material 222 expands radially when under axial compression to seal against the tubing or casing 220. In one or more exemplary embodiments, the Poisson's ratio of the first material 222 is greater than 0.5 In one or more exemplary embodiments, the Poisson's ratio of the first material 222 is greater than 1.0. That is, applying a compressive force on the first material 222 will cause deformation in the radial direction that is greater than axial deformation. In one or more exemplary embodiments, the first material 222 is not limited to use within a bridge plug, and instead a variety of downhole tools may include the first material 222, such as for example an anchor, packer element, seal, perfballs, etc. In one or more exemplary embodiments, and when the lattice cells within the lattice structure 175 that create the first material 222 are infiltrated with a filler material, such as for example, the elastomer 185, the powder, or the salt/scale from the wellbore fluids, etc., the lattice cells may increase in size in the radial direction more than the filler material may increase in size in the radial direction if the Poisson's ratio of the first material 222 is greater than the Poisson's ratio of the filler material. Thus, a lattice cell may change shape such that a volume defined by the lattice cell may increase from a first volume to a larger second volume while the volume of the filler material remains the same or increases less than the volume defined by the lattice cell. Accordingly, and in one or more exemplary embodiments, applying an axial compressive force on the first material 222 and the filler material after the lattice structure 175 contacts an inner surface of the tubing or casing 220 may compress the lattice cell volume to cause the filler material to contact the inner surface of the tubing or casing 220. Alternatively, and in or more exemplary embodiments, the filler material may be the swellable elastomer 185 that swells from an original volume to the second volume of the lattice cell such that the swellable elastomer contacts the inner surface of the tubing or casing 220. In one or more exemplary embodiments, the filler material is a corrosion product that swells from an original volume to the second volume of the lattice cell.

Figure 8:
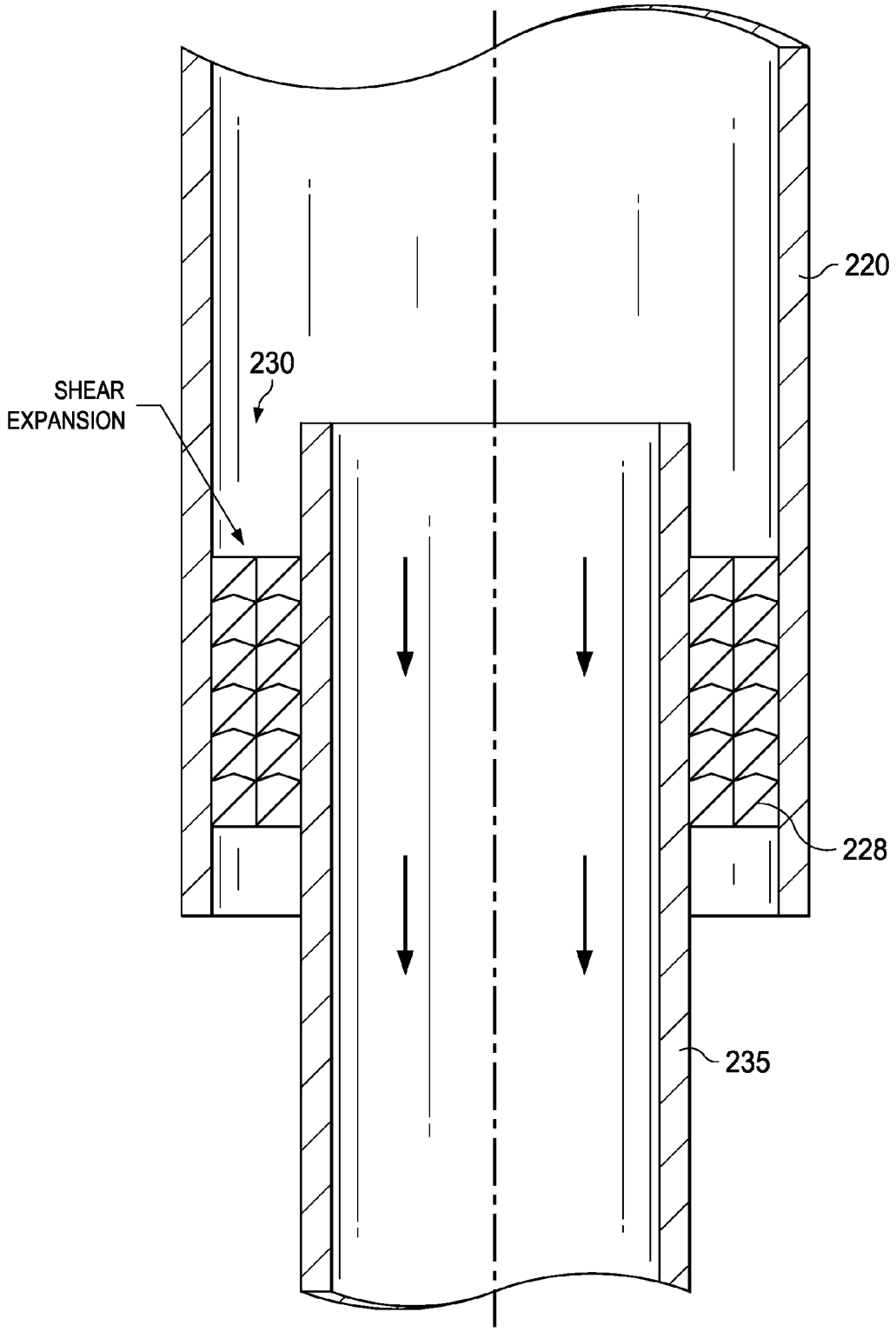
FIG. 8 is a diagrammatic illustration of a sectional view of an anchor, according to an exemplary embodiment of the present disclosure.

In one or more exemplary embodiments, the lattice structure 175 is a shear expanding lattice 228 and forms a portion of an anchor 230 as shown in FIG. 8. In one or more exemplary embodiments, the shear expanding lattice 228 expands in the radial direction when the lattice structure 175 is subjected to an axial shear force. In one or more exemplary embodiments, the anchor 230 is coupled to a tubing string 235 and is coupled to the casing 220, with downward movement of the tubing string 235 applying an axial shear force to the anchor 230. In one or more exemplary embodiments, applying a shear load on the shear expanding lattice 228 will cause the shear expanding lattice 228 to expand radially. In one or more exemplary embodiments, the shear expanding lattice 228 may comprise a portion of a slip, a packer element, a seal, perfballs, etc. In one or more exemplary embodiments, a shear expanding lattice 228 would also be useful as a slip because additional movement in a tool string that included the tubing string 235 would result in additional "locking" or stabilization by the expanding lattice 228 of the tubing string 235 relative to the casing 220.

Figure 9:
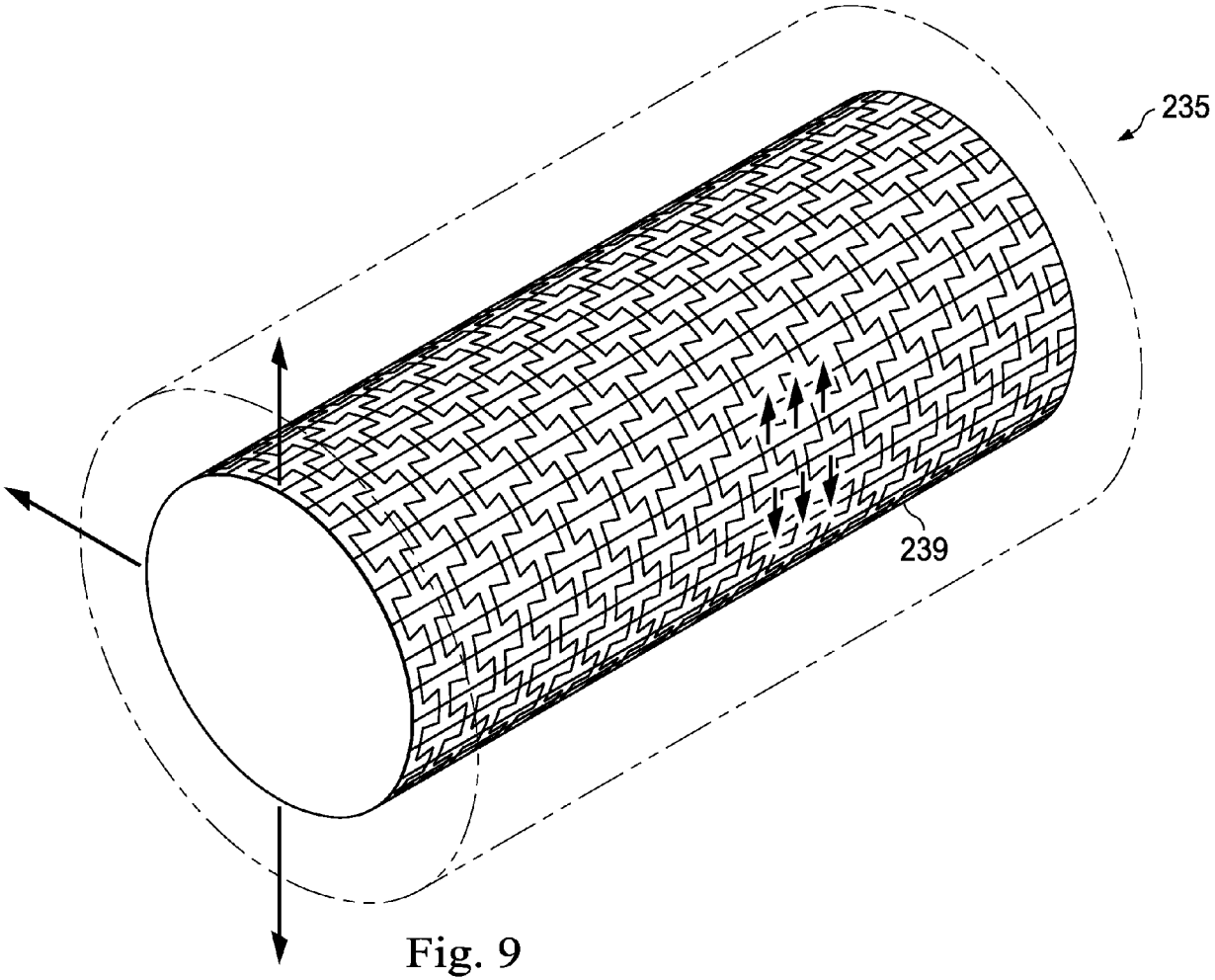
FIG. 9 is a diagrammatic illustration of a filter, according to another exemplary embodiment of the present disclosure.

In one or more exemplary embodiments, the lattice structure 175 may be structured to create a second material 239 in which different Poisson's ratios can be created in different directions within the second material 239. For example, the second material 239 may form the auxetic lattice in one direction while having a very high expansion ratio in the transverse direction. In one or more exemplary embodiments and as illustrated in FIG. 9, the second material 239 forms a sleeve 240 that is radially expandable yet axially very stiff.

In one or more exemplary embodiments, the lattice structure 175 can survive high temperatures, aggressive wellbore fluids, high run-in speeds, and forgiving backup rings. In one or more exemplary embodiments, the lattice structure 175 can create materials that have a Poisson's ratio that is not normally found in nature.

In one or more exemplary embodiments, forces or movement in the axial direction are generally perpendicular to forces or movement in the radial direction.

A method of optimizing the design of a metamaterial that includes the lattice structure 175 includes creating a preliminary design of the component using a mechanical metamaterial; numerically analyzing the design based on a loading profile; changing the preliminary design based on the results from the numerical analysis, which creates a new design; and using additive manufacturing to create the new design to form the lattice structure 175. The components of the design that can be optimized include any one of a lattice cell shape, the weight of the lattice elements, the conformal profile of the lattice, the stiffness of the lattice flexures, or the material in the lattice structure 175.

In one or more exemplary embodiments, the lattice cells may be used to hold or secure a coating to the lattice structure 175 and/or to the skin 180. In one or more exemplary embodiments, securing a coating to the lattice structure 175 and/or to the skin 180 may be appropriate when the lattice structure 175 and/or to the skin 180 forms a portion of the exterior surface of the lattice seal 170. For example, the lattice structure 175 and/or to the skin 180 can be adjacent to a flow path that is at least partially defined by an inner surface of a tubing or the mandrel 165. In one or more exemplary embodiments, the lattice structure 175 and/or to the skin 180 may also be a "skeleton" to hold a second material, such as for example, a synthetic resin. The lattice structure 175 and/or to the skin 180 could be filled with Teflon® or another synthetic resin so that scale and paraffin would have a lower propensity to stick to the tubing or the mandrel 165. In one or more exemplary embodiments, the synthetic resin could also be used to reduce the fluid friction or to reduce tool sliding friction. In one or more exemplary embodiments, using the lattice structure 175 and/or to the skin 180 that is composed of a metal material encourages the Teflon® to stick to the metal material and prevents peeling when exposed to damage. In one or more exemplary embodiments, the lattice cells could also be at least partially filled with any one or more of an erosion resistant coating, an energy absorbing coating, and a corrosion resistant coating. In one or more exemplary embodiments, the coating may also be used for energy dampening. Generally, a viscoelastic material can absorb the energy from particles that would cause erosion and could also be used to absorb acoustic energy such as from acoustic telemetry, acoustic logging, perforating charges, or drilling. However and in one or more exemplary embodiments, the lattice cells within the lattice structure 175 and/or to the skin 180 that is located on a flow surface, or adjacent to the flow path, can remain unfilled. In one or more exemplary embodiments, the unfilled lattice cells may create turbulence to help redirect the flow of a fluid or to provide restriction to the fluid flow. In one or more exemplary embodiments, the lattice structure 175 and/or to the skin 180 that has unfilled lattice cells may also serve as a "shark skin" to reduce fluid friction and to reduce flow separation, with flow separation often resulting in increased drag and increased propensity to form scale. In one or more exemplary embodiments, the lattice structure 175 and/or to the skin 180 that is located on the flow surface can also help with heat transfer, which would encourage the cooling of electronics as well as for flow velocity sensors.

In one or more exemplary embodiments, the lattice structure 175 may be included in, or serve as, a crumple zone and be crushed to absorb energy, which would prevent or reduce the likelihood that sensitive components would be damaged from shock loads. In one or more exemplary embodiments, and using the anisotropy of the lattice structure 175, shock energy may be absorbed in one direction (axial from the bit) while still being stiff to another desired sensitivity direction (such as radial acceleration or collapse pressure). In one or more exemplary embodiments, the lattice structure 175 may make an impression for fishing expeditions. In one or more exemplary embodiments, the lattice structure 175 may be used to create a shear pin or equivalent frangible device. In one or more exemplary embodiments, the lattice cells within the lattice structure 175 may be filled with a degradable material, which would provide different shear strengths to the shear pin. That is, when the lattice cells are filled with the degradable material, the shear pin would be much stronger than after the material has degraded, which could serve as a surface safety device to prevent premature shifting of a tool, such as the accidental firing of a tubing conveyed perforating gun or the accidental shifting of a sleeve. In one or more exemplary embodiments, and after the tool is installed and after the material has degraded, then the shear value is reduced to enable easier shifting of the tool.

In one or more exemplary embodiments, the lattice structure 175 enables a more compliant structure, so that for example packer slips are more likely to be held in place. In one or more exemplary embodiments, the compliance in the packer slip or the element shoe allows for some movement in the component but maintains a holding force. In one or more exemplary embodiments, the lattice structure 175 may be used to maintain a loading on any other moving part, such as elastomeric packer elements. In one or more exemplary embodiments, the compliance of the lattice structure 175 may act as a spring element with variable stiffness and with tailorable stiffness (i.e., having a first spring constant (force per displacement) until a certain displacement is reached, at which point the stiffness increases). In one or more exemplary embodiments, the tailored compliance also allows for more effective load distribution, such as on the sealing surface of a safety valve flapper. In one or more exemplary embodiments, the compliance may have a negative stiffness. In one or more exemplary embodiments, the lattice structure 175 is constructed from lattices of different stiffnesses and/or widths. In one or more exemplary embodiments, as the lattice structure 175*a* is initially pulled, the stiffness is positive (force/stroke>0). In one or more exemplary embodiments, and as the pull is increased, the stiffness becomes negative. In one or more exemplary embodiments, with the variable stiffness, different stiffnesses may be created in different directions. For example, a low stiffness (high compliance) may be present on the sealing surfaces and in the transverse direction, and where high force is needed the lattice structure 175 can exhibit high stiffness in the pressure holding direction. In one or more exemplary embodiments, the high compliances on the sealing surfaces allows for achieving a consistent contact between the sealing surfaces even if the surfaces are damaged or defective. In one or more exemplary embodiments, the high stiffness allows for holding a high load and for minimizing extrusion.

In one or more exemplary embodiments, the lattice structure 175 has an open cell porous structure, which may be used to filter solids from a fluid. Thus, a hydrostatic set tool or a hydraulic set tool may include the lattice structure 175 to act as a filter on the entrance of the tool. In one or more exemplary embodiments, the lattice structure 175 provides a high porosity and thus lower pressure drop. In one or more exemplary embodiments, the lattice structure 175 can also be engineered to have varying porosity or pore size along an axis, similar to PetroGuard® Advanced Mesh screen by Halliburton Energy Services of Houston, Tex. In one or more exemplary embodiments, the lattice structure 175 is different from a woven mesh, such as in the PetroGuard® Advanced Mesh screen, because the lattice structure 175 is constructed via an additive manufacturing technique, or three dimensional ("3D") printing rather than a woven process.

In one or more exemplary embodiments, the lattice structure 175 may be designed to create a tortuous pathway, which provides a flow restriction. In one or more exemplary embodiments and for the hydraulic set tool, the tortuous pathway restricts the speed at which the tool sets and prevents dynamic damage from occurring. In one or more exemplary embodiments, providing the hydraulic set tool with the lattice structure 175 eliminates the need for some jet components, which can be costly and difficult to install. In one or more exemplary embodiments, additional friction from flow through a screen formed from the lattice structure 175 would allow for a better distribution of the flow of a liquid, which is very important for gas wells that are using inflow control devices, as well as for injection wells that have limited entry.

In one or more exemplary embodiments, the lattice structure 175 may serve as the equivalent of a honeycomb structure to provide support to load bearing walls. In one or more exemplary embodiments, the lattice structure 175 provides an open volume for use as a hydraulic chamber, a vacuum chamber, or as a liquid spring. In one or more exemplary embodiments, a portion of the lattice cells within the lattice structure 175 stores fluid.

In one or more exemplary embodiments, the lattice structure 175 may form a portion of one or more walls of a pressure housing or provide strain relief at the edges of pressure housings.

In one or more exemplary embodiments, the lattice structure 175 may be used to form at least a portion of an expandable tubular, such as for example an expandable patch, an expandable liner, an expandable casing, an expandable hanger, and an expandable screen. In one or more exemplary embodiments, and when the lattice structure 175 is used form a portion of an expandable screen, the expandable screen is configured to expand and filter. In one or more exemplary embodiments, the lattice structure 175 may provide a consistent filter size as the expansion changes.

In one or more exemplary embodiments, a portion of the lattice structure 175 may be designed with lattice elements that behave like expandable the truss members as described in U.S. Patent Application No. 2013/0220643, the entire disclosure of which is hereby incorporated by reference. In one or more exemplary embodiments, the lattice cells in the lattice structure 175 could be configured such that the lattice cells are a smaller version of the pattern cut into the expandable truss support structure, which gives the expandable truss support structure a large expansion ratio. This would be beneficial because it would limit the amount of damage done to the hydraulic inflation setting tool used to expand the support structure. Truss elements could also be made with rounded edges, which would further reduce the damage done to the inflatable tool.

In one or more exemplary embodiments, a downhole tool that includes the lattice structure 175 may be run in-hole quickly, which saves rig time and associated operational expenses. In one or more exemplary embodiments, the cost of poor quality ("COPQ") associated with back-ups and premature deployment would be reduced or eliminated when the lattice structure 175 forms a portion of the downhole tool. In one or more exemplary embodiments, the downhole tool that includes the lattice structure 175 may require less material, and therefore may be associated with reduced cost. In one or more exemplary embodiments, the downhole tool that includes the lattice structure 175 may have less mass. In one or more exemplary embodiments, the downhole tool that includes the lattice structure 175 has lower density than a solid structure and, thus, has less mass for the same volume. In one or more exemplary embodiments, the downhole tool that includes the lattice structure 175 forms a compliant mechanism. That is, the downhole tool that includes the lattice structure 175 can be designed to move under load. In one or more exemplary embodiments, the downhole tool that includes the lattice structure 175 may increase vibration dampening. In one or more exemplary embodiments, the downhole tool that includes the lattice structure 175 dampens vibrations, as the bending of the lattice structure 175 absorbs and dampens the vibrations much better than a solid structure.

In one or more exemplary embodiments, the lattice seal 170 and/or the lattice structure 175 are not limited to packer applications. The lattice seal 170 and/or the lattice structure 175 may be used in crumple zones such that the lattice structure 175 is designed to be crushed or to be compacted while under load and/or may be used as a filled lattice, such that the lattice structure 175 can be filled with another component that either provides stiffness, compliance, sealing, or chemical delivery. Additionally, the lattice seal 170 and/or the lattice structure 175 may be used to create a non-isotropic, non-homogenous metal. For example, a lattice structure 175, especially a layered lattice, may be used to create a metallic component that is non-isotropic or non-homogenous (i.e., additional stiffness could be designed into the part at one point and additional compliance at another or the component could have reduced stiffness for axial motion but retain high stiffness in burst and collapse).

In one or more exemplary embodiments, the sealing surface of the lattice seals 170, 190, and 200 may contact an inner surface of the wellbore if the wellbore is an open hole wellbore.

Figure 10:
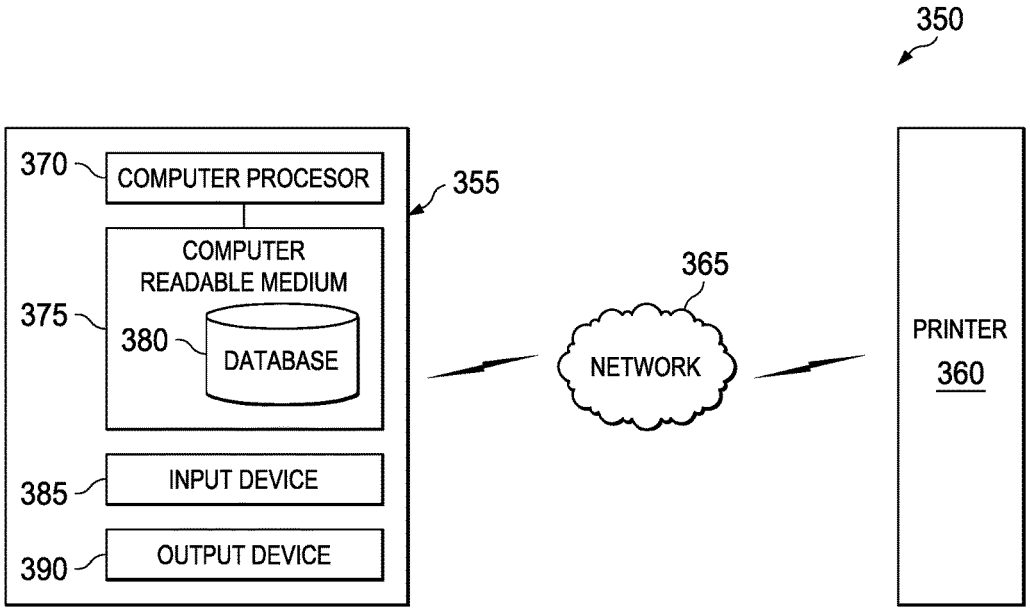
FIG. 10 illustrates an additive manufacturing system, according to an exemplary embodiment.

In one or more exemplary embodiments and as shown in FIG. 10, a downhole tool printing system 350 includes one or more computers 355 and a printer 360 that are operably coupled together, and in communication via a network 365. In one or more exemplary embodiments, any portion of any one of the lattice seals 170, 190, 200, the skin 180, or the lattice structure 175 may be manufactured using the downhole tool printing system 350. However, the downhole tool printing system 350 may be used to manufacture a variety of downhole tools. In one or more exemplary embodiments, the downhole tool printing system 350 may modify existing parts in situ or interactively upgrade existing parts in real time during the development process to further accelerate a prototyping process.

In one or more exemplary embodiments, the one or more computers 355 includes a computer processor 370 and a computer readable medium 375 operably coupled thereto. Instructions accessible to, and executable by, the computer processor 370 are stored on the computer readable medium 375. A database 380 is also stored in the computer readable medium 375. In one or more exemplary embodiments, the computer 355 also includes an input device 385 and an output device 390. In one or more exemplary embodiments, web browser software is stored in the computer readable medium 375. In one or more exemplary embodiments, three dimension modeling software is stored in the computer readable medium. In one or more exemplary embodiments, software that includes advanced numerical method for topology optimization, which assists in determining optimum void shape, void size distribution, and void density distribution or other topological features in any portion of any one of the lattice seals 170, 190, 200, the skin 180, or the lattice structure 175, is stored in the computer readable medium. In one or more exemplary embodiments, software involving finite element analysis and topology optimization is stored in the computer readable medium. In one or more exemplary embodiments, the input device 385 is a keyboard, mouse, or other device coupled to the computer 355 that sends instructions to the computer 355. In one or more exemplary embodiments, the input device 385 and the output device 390 include a graphical display, which, in several exemplary embodiments, is in the form of, or includes, one or more digital displays, one or more liquid crystal displays, one or more cathode ray tube monitors, and/or any combination thereof. In one or more exemplary embodiments, the output device 390 includes a graphical display, a printer, a plotter, and/or any combination thereof. In one or more exemplary embodiments, the input device 385 is the output device 390, and the output device 390 is the input device 385. In several exemplary embodiments, the computer 355 is a thin client. In several exemplary embodiments, the computer 355 is a thick client. In several exemplary embodiments, the computer 355 functions as both a thin client and a thick client. In several exemplary embodiments, the computer 355 is, or includes, a telephone, a personal computer, a personal digital assistant, a cellular telephone, other types of telecommunications devices, other types of computing devices, and/or any combination thereof. In one or more exemplary embodiments, the computer 355 is capable of running or executing an application. In one or more exemplary embodiments, the application is an application server, which in several exemplary embodiments includes and/or executes one or more web-based programs, Intranet-based programs, and/or any combination thereof. In one or more exemplary embodiments, the application includes a computer program including a plurality of instructions, data, and/or any combination thereof. In one or more exemplary embodiments, the application written in, for example, HyperText Markup Language (HTML), Cascading Style Sheets (CSS), JavaScript, Extensible Markup Language (XML), asynchronous JavaScript and XML (Ajax), and/or any combination thereof.

In one or more exemplary embodiments, the printer 360 is a conventional three-dimensional printer. In one or more exemplary embodiments, the printer 360 includes a layer deposition mechanism for depositing material in successive adjacent layers; and a bonding mechanism for selectively bonding one or more materials deposited in each layer. In one or more exemplary embodiments, the printer 360 is arranged to form a unitary printed body by depositing and selectively bonding a plurality of layers of material one on top of the other. In one or more exemplary embodiments, the printer 360 is arranged to deposit and selectively bond two or more different materials in each layer, and wherein the bonding mechanism includes a first device for bonding a first material in each layer and a second device, different from the first device, for bonding a second material in each layer. In one or more exemplary embodiments, the first device is an ink jet printer for selectively applying a solvent, activator or adhesive onto a deposited layer of material. In one or more exemplary embodiments, the second device is a laser for selectively sintering material in a deposited layer of material. In one or more exemplary embodiments, the layer deposition means includes a device for selectively depositing at least the first and second materials in each layer. In one or more exemplary embodiments, any one of the two or more different materials may be ABS plastic, PLA, polyamide, glass filled polyamide, sterolithography materials, silver, titanium, steel, wax, photopolymers, polycarbonate, and a variety of other materials. In one or more exemplary embodiments, the printer 360 may involve fused deposition modeling, selective laser sintering or laser melting, multi-jet modeling, stereolithography, fused deposition modeling, and/or photopolymerization.

Figure 11:
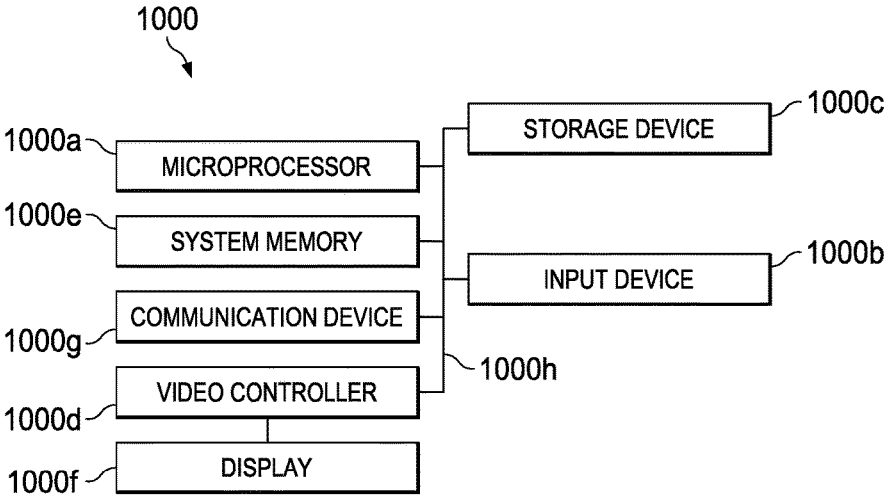
FIG. 11 is a diagrammatic illustration of a node for implementing one or more exemplary embodiments of the present disclosure, according to an exemplary embodiment.

In one or more exemplary embodiments, as illustrated in FIG. 11 with continuing reference to FIGS. 1-10, an illustrative computing device 1000 for implementing one or more embodiments of one or more of the above-described networks, elements, methods and/or steps, and/or any combination thereof, is depicted. The computing device 1000 includes a processor 1000*a*, an input device 1000*b*, a storage device 1000*c*, a video controller 1000*d*, a system memory 1000*e*, a display 1000*f*, and a communication device 1000*g*, all of which are interconnected by one or more buses 1000*h*. In several exemplary embodiments, the storage device 1000*c* may include a floppy drive, hard drive, CD-ROM, optical drive, any other form of storage device and/or any combination thereof. In several exemplary embodiments, the storage device 1000*c* may include, and/or be capable of receiving, a floppy disk, CD-ROM, DVD-ROM, or any other form of computer readable medium that may contain executable instructions. In one or more exemplary embodiments, the computer readable medium is a non-transitory tangible media. In several exemplary embodiments, the communication device 1000*g* may include a modem, network card, or any other device to enable the computing device 1000 to communicate with other computing devices. In several exemplary embodiments, any computing device represents a plurality of interconnected (whether by intranet or Internet) computer systems, including without limitation, personal computers, mainframes, PDAs, smartphones and cell phones.

In several exemplary embodiments, the one or more computers 355, the printer 360, and/or one or more components thereof, are, or at least include, the computing device 1000 and/or components thereof, and/or one or more computing devices that are substantially similar to the computing device 1000 and/or components thereof. In several exemplary embodiments, one or more of the above-described components of one or more of the computing device 1000, one or more computers 355, and the printer 360 and/or one or more components thereof, include respective pluralities of same components.

In several exemplary embodiments, a computer system typically includes at least hardware capable of executing machine readable instructions, as well as the software for executing acts (typically machine-readable instructions) that produce a desired result. In several exemplary embodiments, a computer system may include hybrids of hardware and software, as well as computer sub-systems.

In several exemplary embodiments, hardware generally includes at least processor-capable platforms, such as client-machines (also known as personal computers or servers), and hand-held processing devices (such as smart phones, tablet computers, personal digital assistants (PDAs), or personal computing devices (PCDs), for example). In several exemplary embodiments, hardware may include any physical device that is capable of storing machine-readable instructions, such as memory or other data storage devices. In several exemplary embodiments, other forms of hardware include hardware sub-systems, including transfer devices such as modems, modem cards, ports, and port cards, for example.

In several exemplary embodiments, software includes any machine code stored in any memory medium, such as RAM or ROM, and machine code stored on other devices (such as floppy disks, flash memory, or a CD ROM, for example). In several exemplary embodiments, software may include source or object code. In several exemplary embodiments, software encompasses any set of instructions capable of being executed on a computing device such as, for example, on a client machine or server.

In several exemplary embodiments, combinations of software and hardware could also be used for providing enhanced functionality and performance for certain embodiments of the present disclosure. In one or more exemplary embodiments, software functions may be directly manufactured into a silicon chip. Accordingly, it should be understood that combinations of hardware and software are also included within the definition of a computer system and are thus envisioned by the present disclosure as possible equivalent structures and equivalent methods.

In several exemplary embodiments, computer readable mediums include, for example, passive data storage, such as a random access memory (RAM) as well as semi-permanent data storage such as a compact disk read only memory (CD-ROM). One or more exemplary embodiments of the present disclosure may be embodied in the RAM of a computer to transform a standard computer into a new specific computing machine. In several exemplary embodiments, data structures are defined organizations of data that may enable an embodiment of the present disclosure. In one or more exemplary embodiments, a data structure may provide an organization of data, or an organization of executable code.

In several exemplary embodiments, the network 365, and/or one or more portions thereof, may be designed to work on any specific architecture. In one or more exemplary embodiments, one or more portions of the network 365 may be executed on a single computer, local area networks, client-server networks, wide area networks, internets, hand-held and other portable and wireless devices and networks.

In several exemplary embodiments, a database may be any standard or proprietary database software, such as Oracle, Microsoft Access, SyBase, or DBase II, for example. In several exemplary embodiments, the database may have fields, records, data, and other database elements that may be associated through database specific software. In several exemplary embodiments, data may be mapped. In several exemplary embodiments, mapping is the process of associating one data entry with another data entry. In one or more exemplary embodiments, the data contained in the location of a character file can be mapped to a field in a second table. In several exemplary embodiments, the physical location of the database is not limiting, and the database may be distributed. In one or more exemplary embodiments, the database may exist remotely from the server, and run on a separate platform. In one or more exemplary embodiments, the database may be accessible across the Internet. In several exemplary embodiments, more than one database may be implemented.

In several exemplary embodiments, a computer program, such as a plurality of instructions stored on a computer readable medium, such as the computer readable medium 375, the system memory 1000*e*, and/or any combination thereof, may be executed by a processor to cause the processor to carry out or implement in whole or in part the operation of the system 350, and/or any combination thereof. In several exemplary embodiments, such a processor may include one or more of the computer processor 370, the processor 1000*a*, and/or any combination thereof. In several exemplary embodiments, such a processor may execute the plurality of instructions in connection with a virtual computer system.

In several exemplary embodiments, a plurality of instructions stored on a non-transitory computer readable medium may be executed by one or more processors to cause the one or more processors to carry out or implement in whole or in part the above-described operation of each of the above-described exemplary embodiments of the system, the method, and/or any combination thereof. In several exemplary embodiments, such a processor may include one or more of the microprocessor 1000*a*, any processor(s) that are part of the components of the system, and/or any combination thereof, and such a computer readable medium may be distributed among one or more components of the system. In several exemplary embodiments, such a processor may execute the plurality of instructions in connection with a virtual computer system. In several exemplary embodiments, such a plurality of instructions may communicate directly with the one or more processors, and/or may interact with one or more operating systems, middleware, firmware, other applications, and/or any combination thereof, to cause the one or more processors to execute the instructions.

In one or more exemplary embodiments, the instructions may be generated, using in part, advanced numerical method for topology optimization to determine optimum shape, size, density, and distribution of the voids formed within any portion of any one of the lattice seals 170, 190, 200, the skin 180, or the lattice structure 175, or other topological features.

During operation of the system 350, the computer processor 370 executes the plurality of instructions that causes the manufacture of any portion of any one of the lattice seals 170, 190, 200, skin 180, or the lattice structure 175 using additive manufacturing. Thus, any portion of any one of the lattice seals 170, 190, 200, skin 180, or the lattice structure 175 are at least partially manufactured using an additive manufacturing process. In one or more exemplary embodiments, any portion of any one of the lattice seals 170, 190, 200, skin 180, or the lattice structure 175 are engineered to have extremely high strength-to-weight ratios, customizable stiffness and modulus, and even more exotic bulk properties such as auxeticism (where a material exhibits a negative Poisson's ratio, such that it increases in thickness under tensile load), a thin skin, and combinations thereof that are fabricated using additive manufacturing. Thus, the back-up system, and swab/premature setting resistance can be built into an element itself, instead of relying on additional tool components or operational limitations.

In several exemplary embodiments, while different steps, processes, and procedures are described as appearing as distinct acts, one or more of the steps, one or more of the processes, and/or one or more of the procedures may also be performed in different orders, simultaneously and/or sequentially. In several exemplary embodiments, the steps, processes and/or procedures may be merged into one or more steps, processes and/or procedures. In several exemplary embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Thus, a downhole tool has been described. Embodiments of the downhole tool may generally include an elongated base pipe and an expandable element disposed on the base pipe and that is radially expandable from a first configuration to a second configuration. For any of the foregoing embodiments, downhole tool may include any one of the following elements, alone or in combination with each other:

The expandable element includes a first lattice structure that includes a first plurality of connecting members; a second plurality of connecting members movable relative to the first plurality of connecting members to allow the expandable element to radially expand from the first configuration to the second configuration; and a plurality of cells, each of the cells being defined between at least two connecting members.

Each of the at least two connecting members is part of either the first plurality of connecting members or the second plurality of connecting members.

The first lattice structure is at least partially manufactured using an additive manufacturing process.

The downhole tool is a packer assembly that is adapted to extend within a pre-existing structure, the pre-existing structure defining a circumferentially extending inner surface.

A swellable elastomer is accommodated in one or more of the cells in the plurality of cells.

One or more of the cells in the plurality of cells defines a first volume.

The one of more of the cells in the plurality of cells defines a second volume that is greater than the first volume.

The swellable elastomer is expandable from a third volume that corresponds to the first volume to a fourth volume that corresponds to the second volume.

When the packer assembly extends within the pre-existing structure and when the expandable element is in the second configuration, the swellable elastomer is adapted to expand to the fourth volume to sealingly engage the inner surface.

A swellable elastomer accommodated in one or more of the cells in the plurality of cells; and wherein the swellable elastomer is adapted to expand from the third volume to the fourth volume to cause the expandable element to radially expand from the first configuration to the second configuration.

A second lattice structure forming an exterior skin of the expandable element, the exterior skin have a circumference, the second lattice structure including a third plurality of connecting members; and a fourth plurality of connecting members movable relative to the third plurality of connecting members to allow the circumference of the exterior surface to expand when the expandable element radially expands from the first configuration to the second configuration.

The downhole tool is a packer assembly.

A first blocking member and a second blocking member, each of the first blocking member and the second blocking member adapted to exert an axial compression force on the expandable element.

The expandable element is adapted to radially expand from the first configuration to the second configuration in response to the respective compression forces exerted by the first blocking member and the second blocking member.

The first lattice includes at least one of: a uniform lattice structure; a non-uniform lattice structure; and a conformal lattice.

The elongated based pipe is adapted to extend within a pre-existing structure, the pre-existing structure defining a circumferentially extending inner surface; wherein an interior surface of the expandable element is adapted to be in contact with the base pipe and an exterior surface of the expandable element is in contact with the inner surface; and wherein the expandable element is an anchor and the first lattice structure expands from the first configuration to the second configuration in response to an axial shear force applied to the expandable element.

The first lattice structure is composed of a metal.

The downhole tool is any one of: an expansion joint; a travel joint; an anchor; a seal bore; and a bridge plug.

Thus, a method has been described. Embodiments of the method may generally include positioning a packer assembly between first and second zones of a wellbore and expanding the expandable element in a radially outward direction to sealingly engage an inner surface of the wellbore and to move the first plurality of connecting members relative to the second plurality of connecting members. For any of the foregoing embodiments, the method may include any one of the following, alone or in combination with each other:

A expandable element disposed on the base pipe, the expandable element including a first lattice structure that includes: a first plurality of connecting members; a second plurality of connecting members movable relative to the first plurality of connecting members to allow the expandable element to radially expand from the first configuration to the second configuration; and a first plurality of cells, each of the cells within the first plurality of cells being defined between at least two connecting members; wherein each of the at least two connecting members is part of either the first plurality of connecting members or the second plurality of connecting members.

The first lattice structure is at least partially manufactured using an additive manufacturing process.

When the expandable element is in the first configuration, one of the cells in the plurality of cells defines a first volume.

When the expandable element is in the second configuration, the one of the cells in the plurality of cells defines a second volume that is greater than the first volume.

The expandable element further includes a swellable elastomer in one or more of the cells in the plurality of cells, the swellable elastomer expandable from a third volume that corresponds to the first volume to a fourth volume that corresponds to the second volume.

Expanding the swellable elastomer from the third volume to the fourth volume to sealingly engage the inner surface of the wellbore.

The expandable element further includes a second lattice structure defining an exterior skin of the expandable element, the exterior skin having a circumference.

The second lattice structure includes: a third plurality of connecting members; and a fourth plurality of connecting members movable relative to the third plurality of connecting members to allow the circumference of the exterior surface to expand when the expandable element radially expand from the first configuration to the second configuration.

When, in response to expanding the expandable element in the radially outward direction, the circumference of the exterior skin expands and the third plurality of connecting members moves relative to the fourth plurality of connecting members.

The packer assembly further includes a first blocking member and a second blocking member, each of the first blocking member and the second blocking member being adapted to exert an axial compression force on the expandable element; and wherein the method further includes axially compressing the packer assembly, using the first and second blocking members, such that the expandable element expands radially outward.

The expandable element further includes a swellable elastomer accommodated in one or more of the plurality of cells; wherein expanding the expandable element in the radially outward direction includes swelling the swellable elastomer.

The first lattice structure is an auxetic lattice.

The first lattice structure is composed of a metal.

Expanding the expandable element in the radially outward direction includes capturing debris from downhole fluids within one or more of the cells in the plurality of cells.

The first lattice includes at least one of: a uniform lattice structure; a non-uniform lattice structure; and a conformal lattice.

The foregoing description and figures are not drawn to scale, but rather are illustrated to describe various embodiments of the present disclosure in simplistic form. Although various embodiments and methods have been shown and described, the disclosure is not limited to such embodiments and methods and will be understood to include all modifications and variations as would be apparent to one skilled in the art. Therefore, it should be understood that the disclosure is not intended to be limited to the particular forms disclosed. Accordingly, the intention is to cover all modifications, equivalents and alternatives falling within the spirit and scope of the disclosure as defined by the appended claims.

What is claimed is:

1. A downhole tool, comprising:

an elongated base pipe; and an expandable element disposed on the base pipe and radially expandable from a first configuration to a second configuration;

wherein the expandable element comprises:

a first lattice structure comprising:

a first plurality of connecting members;

a second plurality of connecting members movable relative to the first plurality of connecting members to allow the expandable element to radially expand from the first configuration to the second configuration; and a first plurality of cells, each of the cells in the first plurality of cells being defined between at least a connecting member from each of the first plurality of connecting members and the second plurality of connecting members; and a second lattice structure that is different from the first lattice structure, wherein the second lattice structure comprises:

a third plurality of connecting members;

a fourth plurality of connecting members movable relative to the third plurality of connecting members to allow the expandable element to radially expand from the first configuration to the second configuration; and a second plurality of cells, each of the cells in the second plurality of cells being defined between at least a connecting member from each of the third plurality of connecting members and the fourth plurality of connecting members;

wherein the second lattice structure is adjacent to the first lattice structure in a longitudinal or radial direction relative to the elongated base pipe;

wherein, when the expandable element is in the first configuration, one or more of the cells in the first plurality of cells defines a first volume;

wherein, when the expandable element is in the second configuration, one of more of the cells in the first plurality of cells defines a second volume that is greater than the first volume;

wherein the downhole tool is a packer assembly that is adapted to extend within a pre-existing structure, the pre-existing structure defining a circumferentially extending inner surface;

wherein the expandable element further comprises a swellable elastomer accommodated in one or more of the cells in the first plurality of cells, wherein the swellable elastomer is expandable from a third volume that corresponds to the first volume to a fourth volume that corresponds to the second volume; and wherein, when the packer assembly extends within the pre-existing structure and the expandable element is in the second configuration, the swellable elastomer is adapted to expand to the fourth volume to sealingly engage the inner surface.

2. A downhole tool, comprising:

an elongated base pipe; and an expandable element disposed on the base pipe and radially expandable from a first configuration to a second configuration;

wherein the expandable element comprises:

a first lattice structure comprising:

a first plurality of connecting members;

a second plurality of connecting members movable relative to the first plurality of connecting members to allow the expandable element to radially expand from the first configuration to the second configuration; and a first plurality of cells, each of the cells in the first plurality of cells being defined between at least a connecting member from each of the first plurality of connecting members and the second plurality of connecting members; and a second lattice structure that is different from the first lattice structure, wherein the second lattice structure comprises:

a third plurality of connecting members;

a fourth plurality of connecting members movable relative to the third plurality of connecting members to allow the expandable element to radially expand from the first configuration to the second configuration; and a second plurality of cells, each of the cells in the second plurality of cells being defined between at least a connecting member from each of the third plurality of connecting members and the fourth plurality of connecting members;

wherein the second lattice structure is adjacent to the first lattice structure in a longitudinal or radial direction relative to the elongated base pipe;

wherein, when the expandable element is in the first configuration, one or more of the cells in the first plurality of cells defines a first volume;

wherein, when the expandable element is in the second configuration, one of more of the cells in the first plurality of cells defines a second volume that is greater than the first volume;

wherein the expandable element further comprises a swellable elastomer accommodated in one or more of the cells in the first plurality of cells, wherein the swellable elastomer is expandable from a third volume that corresponds to the first volume to a fourth volume that corresponds to the second volume; and wherein the swellable elastomer is adapted to expand from the third volume to the fourth volume to cause the expandable element to radially expand from the first configuration to the second configuration.

3. The downhole tool of claim 2, wherein the first lattice structure is at least partially manufactured using an additive manufacturing process.

4. The downhole tool of claim 2, wherein the second lattice structure is adjacent to the first lattice structure in the radial direction relative to the elongated base pipe and defines an exterior skin of the expandable element, the exterior skin having a circumference; and wherein the fourth plurality of connecting members are movable relative to the third plurality of connecting members to allow the circumference of the exterior surface to expand when the expandable element radially expands from the first configuration to the second configuration.

5. The downhole tool of claim 2, wherein the first lattice comprises at least one of: a uniform lattice structure; a non-uniform lattice structure; and a conformal lattice.

6. The downhole tool of claim 2, wherein the first lattice structure is composed of a metal.

7. The downhole tool of claim 2, wherein the downhole tool is any one of: an expansion joint; a travel joint; an anchor; a screen filter; a seal bore; and a bridge plug.

8. A downhole tool, comprising:

an elongated base pipe; and an expandable element disposed on the base pipe and radially expandable from a first configuration to a second configuration;

wherein the expandable element comprises:

a first lattice structure comprising:

a first plurality of connecting members;

a second plurality of connecting members movable relative to the first plurality of connecting members to allow the expandable element to radially expand from the first configuration to the second configuration; and a first plurality of cells, each of the cells in the first plurality of cells being defined between at least a connecting member from each of the first plurality of connecting members and the second plurality of connecting members; and a second lattice structure that is different from the first lattice structure, wherein the second lattice structure comprises:

a third plurality of connecting members;

a fourth plurality of connecting members movable relative to the third plurality of connecting members to allow the expandable element to radially expand from the first configuration to the second configuration; and a second plurality of cells, each of the cells in the second plurality of cells being defined between at least a connecting member from each of the third plurality of connecting members and the fourth plurality of connecting members;

wherein the second lattice structure is adjacent to the first lattice structure in a longitudinal or radial direction relative to the elongated base pipe;

wherein, when the expandable element is in the first configuration, one or more of the cells in the first plurality of cells defines a first volume;

wherein, when the expandable element is in the second configuration, one of more of the cells in the first plurality of cells defines a second volume that is greater than the first volume;

wherein the downhole tool is a packer assembly and further comprises: a first blocking member and a second blocking member, each of the first blocking member and the second blocking member adapted to exert an axial compression force on the expandable element; and wherein the expandable element is adapted to radially expand from the first configuration to the second configuration in response to the respective compression forces exerted by the first blocking member and the second blocking member.

9. A downhole tool, comprising:

an elongated base pipe; and an expandable element disposed on the base pipe and radially expandable from a first configuration to a second configuration;

wherein the expandable element comprises:

a first lattice structure comprising:

a first plurality of connecting members;

a second plurality of connecting members movable relative to the first plurality of connecting members to allow the expandable element to radially expand from the first configuration to the second configuration; and a first plurality of cells, each of the cells in the first plurality of cells being defined between at least a connecting member from each of the first plurality of connecting members and the second plurality of connecting members; and a second lattice structure that is different from the first lattice structure, wherein the second lattice structure comprises:

a third plurality of connecting members;

a fourth plurality of connecting members movable relative to the third plurality of connecting members to allow the expandable element to radially expand from the first configuration to the second configuration; and a second plurality of cells, each of the cells in the second plurality of cells being defined between at least a connecting member from each of the third plurality of connecting members and the fourth plurality of connecting members;

wherein the second lattice structure is adjacent to the first lattice structure in a longitudinal or radial direction relative to the elongated base pipe;

wherein, when the expandable element is in the first configuration, one or more of the cells in the first plurality of cells defines a first volume;

wherein, when the expandable element is in the second configuration, one of more of the cells in the first plurality of cells defines a second volume that is greater than the first volume;

wherein the elongated based pipe is adapted to extend within a pre-existing structure, the pre-existing structure defining a circumferentially extending inner surface;

wherein an interior surface of the expandable element is in contact with the base pipe, and an exterior surface of the expandable element is adapted to be in contact with the inner surface of the pre-existing structure; and wherein the expandable element is an anchor and the first lattice structure expands from the first configuration to the second configuration in response to an axial shear force applied to the expandable element such that the base pipe applies a first force to the interior surface of the expandable element in a first direction and the inner surface of the elongated base pipe applies a second force to the exterior surface of the expandable element in a second direction that is opposite the first direction.

10. A method comprising:

positioning a packer assembly between first and second zones of a wellbore, the packer assembly comprising:

an expandable element disposed on the base pipe, the expandable element comprising:

a first lattice structure that comprises:

a first plurality of connecting members;

a second plurality of connecting members movable relative to the first plurality of connecting members to allow the expandable element to radially expand from the first configuration to the second configuration; and a first plurality of cells, each of the cells within the first plurality of cells being defined between at least a connecting member from each of the first plurality of connecting members and the second plurality of connecting members;

and a second lattice structure that is different from the first lattice structure, wherein the second lattice structure comprises:

a third plurality of connecting members;

a fourth plurality of connecting members movable relative to the third plurality of connecting members to allow the expandable element to radially expand from the first configuration to the second configuration; and a second plurality of cells, each of the cells in the second plurality of cells being defined between at least a connecting member from each of the third plurality of connecting members and the fourth plurality of connecting members;

wherein the second lattice structure is adjacent to the first lattice structure in a longitudinal or radial direction relative to the elongated base pipe; and expanding the expandable element in a radially outward direction to move the first plurality of connecting members relative to the second plurality of connecting members and to move the third plurality of connecting members relative to the fourth plurality of connecting members;

wherein, when the expandable element is in the first configuration, one of the cells in the first plurality of cells defines a first volume; and wherein, when the expandable element is in the second configuration, the one of the cells in the first plurality of cells defines a second volume that is greater than the first volume.

11. The method of claim 10, wherein the first lattice structure is at least partially manufactured using an additive manufacturing process.

12. The method of claim 11, wherein the second lattice structure defines an exterior skin of the expandable element, the exterior skin having a circumference;

and wherein, in response to expanding the expandable element in the radially outward direction, the circumference of the exterior skin expands.

13. The method of claim 10, wherein the expandable element further comprises a swellable elastomer in one or more of the cells in the first plurality of cells, wherein the swellable elastomer is expandable from a third volume that corresponds to the first volume to a fourth volume that corresponds to the second volume; and wherein the method further comprises expanding the swellable elastomer from the third volume to the fourth volume to sealingly engage the inner surface of the wellbore.

14. The method of claim 10, wherein the packer assembly further comprises a first blocking member and a second blocking member, each of the first blocking member and the second blocking member being adapted to exert an axial compression force on the expandable element; and wherein expanding the expandable element in a radially outward direction comprises axially compressing the expandable element using the first and second blocking member such that the expandable element expands radially outward.

15. The method of claim 10, wherein the expandable element further comprises a swellable elastomer in one or more of the cells in the first plurality of cells, the swellable elastomer being expandable from a third volume that corresponds to the first volume to a fourth volume that corresponds to the second volume; and wherein expanding the expandable element in a radially outward direction comprises expanding the swellable elastomer from the third volume to the fourth volume.

16. The method of claim 10, wherein the first lattice structure is an auxetic lattice.

17. The method of claim 10, wherein the first lattice structure is composed of a metal.

18. The method of claim 10, wherein the first lattice comprises at least one of: a uniform lattice structure; a non-uniform lattice structure; and a conformal lattice.

* * * * *